US005929018A

United States Patent [19]

Baillely et al.

[11] Patent Number: 5,929,018

[45] Date of Patent: Jul. 27, 1999

[54] DETERGENT COMPOSITION COMPRISING A POLYMERIC POLYCARBOXYLIC COMPOUND, A CHELANT, AND AN AMYLASE ENZYME

[75] Inventors: Gerard Marcel Baillely; Richard Timothy Hartshorn; Christian Leo Marie Vermote, all of Newcastle upon Tyne, United Kingdom

[73] Assignee: Procter & Gamble Co., Cincinnati, Ohio

[21] Appl. No.: 08/913,211

[22] PCT Filed: Feb. 20, 1996

[86] PCT No.: PCT/US96/02118

§ 371 Date: Sep. 10, 1997

§ 102(e) Date: Sep. 10, 1997

[87] PCT Pub. No.: WO96/28531

PCT Pub. Date: Sep. 19, 1996

[30] Foreign Application Priority Data

Mar. 11, 1995 [GB] United Kingdom ..... 9504979
Jul. 28, 1995 [GB] United Kingdom ..... 9515573

[51] Int. Cl.[6] ..... C11D 3/386; C11D 3/395; C11D 3/37; C11D 3/10

[52] U.S. Cl. ..... 510/392; 510/222; 510/226; 510/229; 510/228; 510/305; 510/306; 510/309; 510/312; 510/320; 510/37; 510/499; 510/467; 510/476

[58] Field of Search ..... 510/222, 226, 510/227, 228, 305, 306, 309, 312, 320, 374, 392, 499, 467, 476

[56] References Cited

U.S. PATENT DOCUMENTS

| | | | |
|---|---|---|---|
| 4,655,954 | 4/1987 | Broze et al. | 252/102 |
| 4,769,168 | 9/1988 | Ouhadi et al. | 252/99 |
| 4,846,993 | 7/1989 | Lentsch et al. | 252/95 |
| 4,919,845 | 4/1990 | Vogt et al. | 252/526 |
| 5,561,235 | 10/1996 | Gosselink et al. | 546/210 |
| 5,584,888 | 12/1996 | Miracle et al. | 8/111 |
| 5,616,546 | 4/1997 | Miracle et al. | 510/223 |
| 5,635,103 | 6/1997 | Willey et al. | 510/313 |
| 5,686,015 | 11/1997 | Willey et al. | 252/186.35 |

*Primary Examiner*—Kery Fries
*Attorney, Agent, or Firm*—C. Brant Cook; Kim W. Zerby; Jacobus C. Rasser

[57] ABSTRACT

There is provided a non-phosphate builder-containing detergent composition formulated with a surfactant, a water-soluble organic polymeric polycarboxylic compound, a chelant, an amylase and a source of alkalinity, wherein (a) said water-soluble organic polymeric polycarboxylic compound is in amount less than 3% by weight, (b) said chelant is in amount from 0.1% to 10% by weight, (c) said amylase is in amount from 0.001% to 5% by weight, and (d) said alkalinity source has the capacity to deliver alkalinity to a wash solution as measured by the alkalinity release test described herein, such that the % weight NaOH equivalent of the composition is greater than 8.0% by weight of the composition. Also provided herein is a method for reducing fabric encrustation which comprises contacting the fabric with an effective amount of an aqueous solution of said detergent composition.

24 Claims, No Drawings

DETERGENT COMPOSITION COMPRISING A POLYMERIC POLYCARBOXYLIC COMPOUND, A CHELANT, AND AN AMYLASE ENZYME

TECHNICAL FIELD

The present invention relates to non-phosphate builder-containing detergent compositions. More particularly, the invention relates to non-phosphate detergent compositions, comprising a surfactant, a water-soluble organic polymeric polycarboxylic compound, a chelant and an amylase together with an alkalinity source, which provide effective soil/stain removal.

BACKGROUND OF THE INVENTION

The satisfactory removal of soils/stains is a particular challenge to the formulator of a detergent composition for use in a washing process such as laundry or machine dishwashing process.

Traditionally, the removal of soils/stains has been achieved by the use of bleach components and also by enzyme components.

Amylases are known as effective soil/stain removal agents, for example, in the removal of starch stains such as chocolate.

Polymeric polycarboxylic acid components are also known in detergent compositions as effective soil suspension and anti-encrustation agents.

Chelating agents are known in detergent compositions for their ability to assists in the removal of organic stains during the laundry process.

Phosphorus containing compounds such as sodium tripolyphosphate have effective builder properties; however environmental concerns have made the use of phosphorus containing compounds less attractive in detergent compositions.

A problem encountered with the use of enzymes as components of detergents is that enzyme activity in the wash may be affected by the presence of other detergent components in the wash solution.

A problem encountered with the use of high level of polymeric polycarboxylic acid compounds when in presence of high level of an alkaline source is the propensity of these polycarboxylic compounds to lead to an overbuilt situation which may impair the amylase activity and then leads to poor soil/stain removal performance. Furthermore, high levels of polymeric polycarboxylic acid compounds increase the cost of the detergents to the consumer. On the other hand, low levels of polymeric polycarboxylic acid compounds may lead to encrustation, especially when using high levels of carbonate/silicate alkalinity in a non phosphate builder-containing detergent composition.

The detergent formulator thus faces the challenge of formulating an environmentally friendly product which maximises soil/stain removal, which minimises the occurence of any unwelcome encrustation, which avoids degradation of the detergent components and which is also inexpensive.

U.S. Pat. No. 4,919,845 discloses a phosphate free detergent composition comprising a polycarboxylate compound and a hydroxy-ethylene 1,1 diphosphonate (HEDP) chelant. Particularly disclosed are high levels of polycarboxylates 3% to 4% by weight, 0.22% to 0.4% by weight of HEDP, 12.5% by weight of an alkalinity source and 0.5% by weight of an enzyme granulate. The described composition is asserted to provide effective antiencrustation benefits.

The Applicants have found that the occurence of encrustation effects arising from use of polymeric polycarboxylic compounds at low levels are related to the level of alkalinity present into the wash solution, the alkalinity being produced by the alkaline components of the composition. A high level of an alkalinity source in the detergent composition tends to exarcerbate the encrustation problem, as does a high level in the wash solution. Whilst reducing the level of alkalinity employed in the wash tends to ameliorate these problems; this is accompanied by a marked negative effect on the stain/soil removal ability.

The Applicants have now surprisingly found that where a non phosphate builder-containing detergent composition containing a surfactant, a water-soluble organic polymeric polycarboxylic compound, a chelant and an amylase together with an alkalinity source is employed, an enhanced stain/soil removal and a reduced encrustation may be obtained.

The Applicants have found that the further addition of compounds enhances the overall soil/stain removal performance. Such additional compounds may be selected from proteases, a source of hydrogen peroxide with or without peroxyacid bleach precursors and mixtures thereof.

It is therefore an object of the present invention to provide compositions suitable for use in laundry and machine dishwashing methods producing enhanced stain removal.

It is a further object of the invention to provide compositions for use in laundry and machine dishwashing methods wherein said compositions show less propensity to cause encrustation.

SUMMARY OF THE INVENTION

According to the present invention there is provided a non-phosphate builder-containing detergent composition formulated with a surfactant, a water-soluble organic polymeric polycarboxylic compound, a chelant, an amylase and a source of alkalinity, wherein a) said water-soluble organic polymeric polycarboxylic compound is in amount less than 3% by weight, b) said chelant is in amount from 0.1% to 10% by weight, c) said amylase is in amount from 0.001% to 5% by weight, and d) said alkalinity source has the capacity to deliver alkalinity to a wash solution as measured by the alkalinity release test described herein, such that the % weight NaOH equivalent of the composition is greater than 8.0% by weight of the composition.

Also provided herein is a method for reducing fabric encrustation which comprises contacting the fabric with an effective amount of an aqueous solution of said detergent composition.

Alkalinity is the combining power of a base measured by the maximum number of equivalents of an acid with which it can react to form a salt. In solution, it represents the carbonates and silicates in the water and is determined by titration with standard datum points.

For the purpose of the invention, alkalinity is defined as the weight equivalent of sodium hydroxide (NaOH) needed to be delivered into the wash to neutralise an equivalent amount of hydrochloric acid.

DETAILED DESCRIPTION OF THE INVENTION

Water-soluble Organic Polymeric Polycarboxylic Compounds

An essential component of the invention is one or more water-soluble organic polymeric polycarboxylic compounds. Preferably these compounds are a homo- or co-polymeric polycarboxylic compounds and most preferably a co-polymeric polycarboxylic compounds in which the acid monomer of said polycarboxylic compound comprises at least two carboxyl groups separated by not more than two carbon atoms. Salts of these polycarboxylic compounds are also considered herein.

Polymeric polycarboxylate compounds are utilised at levels less than 3%, preferably from 0.1% to 3% and more preferably less than 1% by weight.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates are selected from acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than 40% by weight.

Polymeric polycarboxylate materials can also optionally include further monomeric units such as nonionic spacing units. For example, suitable nonionic spacing units may include vinyl alcohol or vinyl acetate.

Particularly preferred polymeric polycarboxylates are co-polymers derived from monomers of acrylic acid and maleic acid. The average molecular weight of such polymers in the acid form preferably ranges from 2,000 to 10,000, more preferably from 4,000 to 7,000 and most preferably from 4,000 to 5,000. Water-soluble salts of such acrylic/maleic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967. The ratio of acrylate to maleate segments in such copolymers will generally range from 30:1 to 1:1, more preferably from 10:1 to 2:1. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Of these acrylic/maleic-based copolymers, the water-soluble salts of copolymers of acrylic acid and maleic acid are preferred.

Another class of polymeric polycarboxylic acid compounds suitable for the purpose of the invention are the homo-polymeric polycarboxylic acid compounds derived from acrylic acid. The average molecular weight of such homo-polymers in the acid form preferably ranges from 2,000 to 100,000, more preferably from 3,000 to 75,000, most preferably from 4,000 to 65,000.

A further example of polymeric polycarboxylic compounds suitable for the purpose of the invention include the maleic/acrylic/vinyl alcohol terpolymers. Such materials are also disclosed in EP 193,360, including, for example, the 45/45/10 terpolymer of acrylic/maleic/vinyl alcohol.

Another example of polymeric polycarboxylic compounds suitable for the purpose of the invention include the biodegradable polyaspartic acid and polyglutamic acid compounds.

Chelants

An essential component of the invention is a chelating agent. Chelating agents generally comprise from 0.1% to 10% by weight of the compositions herein. More preferably, if utilized, the chelating agents will comprise from 0.1% to 3.0% by weight of such compositions.

Chelating agents can be selected from organic phosphonates, amino carboxylates, polyfunctionally-substituted aromatic compounds, nitriloacetic acid and mixtures thereof. Without intending to be bound by theory, it is believed that the benefit of these materials is due in part to their exceptional ability to remove transition metal ions such as iron and manganese ions from washing solutions by formation of soluble chelates.

Organic phosphonates suitable for use as chelating agents in the compositions of the invention, are selcted from ethylenediaminetetrakis (methylenephosphonates) available under the trademark DEQUEST from Monsanto, diethylene triamine penta (methylene phosphonate), ethylene diamine tri (methylene phosphonate), hexamethylene diamine tetra (methylene phosphonate), α-hydroxy-2 phenyl ethyl diphosphonate, methylene diphosphonate, hydroxy 1,1-hexylidene, vinylidene 1,1 diphosphonate, 1,2 dihydroxyethane 1,1 diphosphonate and hydroxy-ethylene 1,1 diphosphonate.

Preferably, these amino phosphonates do not contain alkyl or alkenyl groups with more than 6 carbon atoms.

Amino carboxylates chelating agents include ethylenediaminetetracetates, ethylenediamine disuccinate, N-hydroxyethylethylenediamine triacetates, 2-hydroxypropylene diamine disuccinate, nitrilotriacetates, ethylenediamine tetraproprionates, triethylenetetraaminehexacetates, ethylene triamine pentaacetate, diethylenetriaminepentaacetates, and ethanoldiglycines, alkali metal, ammonium, and substituted ammonium salts therein and mixtures therein.

Preferred amino carboxylates chelants for use herein are ethylenediamine disuccinate ("EDDS"), especially the [S,S] isomer as described in U.S. Pat. No. 4,704,233, ethylenediamine-N,N'-diglutamate (EDDG) and 2-hydroxypropylene-diamine-N,N'-disuccinate (HPDDS) compounds. A most preferred amino carboxylate chelant is ethylenediamine disuccinate.

Polyfunctionally-substituted aromatic chelating agents are also useful in the compositions herein. See U.S. Pat. No. 3,812,044. Preferred compounds of this type in acid form are dihydroxydisulfobenzenes such as 1,2-dihydroxy-3,5-disulfobenzene.

Of these, preferred chelants for the purpose of the invention are the diphosphonate derivatives of the organic phosphonate chelants selected from α-hydroxy-2 phenyl ethyl diphosphonate, methylene diphosphonate, hydroxy 1,1-hexylidene, vinylidene 1,1 diphosphonate, 1,2 dihydroxyethane 1,1 diphosphonate and hydroxy-ethylene 1,1 diphosphonate. A most preferred is hydroxy-ethylene 1,1 diphosphonate.

Amylases

Another essential component of the invention is an amylase.

Amylase enzyme are incorporated into the composition in accordance with the invention at a level of from 0.001% to 5% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl and BAN by Novo Industries A/S. A most preferred amylase is Termamyl.

Alkalinity Source

An essential component of the detergent composition is an alkalinity source.

For the purpose of the invention, alkalinity is defined as the weight equivalent of sodium hydroxide (NaOH) needed to be delivered into the wash to neutralise an equivalent amount of hydrochloric acid.

To enable practical comparison of the relative capacity of compositions containing different alkaline components to deliver alkalinity to a wash solution it is useful to express the alkalinity released on addition of the compositions to the wash solution in terms of % weight equivalent of NaOH. That is, in terms of the % weight of NaOH which would have equivalent 'alkaline effect', e. g. in neutralising acid species, to that of the alkalinity species actually released when the composition is added to the wash. For uniform comparison it is also then useful to define standard wash solution characteristics. Thus, the capacity to deliver alkalinity to a wash solution is herein characterized by reference to a representative test method now described.

Alkalinity Release Test Method

A 1 g sample of detergent composition is added to 100 ml of distilled water at a temperature of 30° C. with stirring at 150 rpm using a magnetic stirrer of size 2 cm, thus providing a 1% detergent solution, as would be a typical concentration of a laundry wash solution. The solution is titrated against a standard HCl solution using any suitable titration method. Commonly known acid-base titration methods employing colorimetric end-point determination methods, for example using chemical end-point indicators are particularly suitable. Thus, the number of moles of HCl which the detergent solution is capable of neutralising is obtained. For the avoidance of doubt, 'neutralising' in this context is defined to mean titrating to pH 7. This number will be equivalent to the number of moles of alkalinity, expressed as NaOH equivalent, present in the detergent solution. Thus, the % weight equivalent NaOH present in the sample of the detergent composition may be calculated as:

% weight equivalent NaOH=100×number of moles NaOH equivalent in solution×Mw of NaOH Theoretical Maximum Alkalinity Where the compositional make up of a detergent product is known, it is possible to calculate the theoretical maximum alkalinity, expressed as % weight equivalent of NaOH, which the product could provide to a solution as the sum over each alkaline species of:

% weight (alkaline species).Mw(NaOH.n/Mw(alkaline species)

where n is the formal negative charge carried by the alkaline species.

As an example, a composition containing 12% sodium carbonate is equivalent to a theoretical maximum of 9.06% NaOH, obtained as (12×40×2)/106, since this amount of NaOH in the composition would theoretically neutralise the same amount of acid as the 12% sodium carbonate alkaline component.

Alkalinity Requirement

In accord with the present invention, the alkalinity source is present in the detergent composition such that the capacity to deliver alkalinity to a wash solution measured by the given test method is such that the % weight NaOH equivalent of the composition is greater than 8.0%, preferably at least 10.6% and most preferably 14.6% by weight of the composition.

The alkalinity source is preferably selected from alkali metal carbonates, alkali metal silicates and mixtures thereof.

Suitable alkali metal carbonates include the alkaline earth and alkali metal carbonates, including sodium carbonate and sesqui-carbonate and mixtures thereof with ultra-fine calcium carbonate as disclosed in German Patent Application No. 2,321,001 published on Nov. 15, 1973.

Suitable silicates include the alkali metal silicate $SiO_2$:$Na_2O$ with a ratio of from 1.0 to 2.8 and 1.6:1 ratio being more preferred. The silicates may be in the form of either the anhydrous salt or a hydrated salt. Sodium silicate with an $SiO_2$:$Na_2O$ ratio of 1.6:1 is the most preferred silicate.

Other compounds which provide free alkalinity in aqueous solution may also be used. Such compounds include the crystalline layered silicate and/or aluminosilicate compounds as described herein after, but also the bicarbonates, hydroxides, borates and phosphates.

Additional Components

The detergent composition of the invention will, of course contain one or more surfactants and additional compounds for enhancing the soil removal performance.

Such compounds include the proteases, a source of hydrogen peroxide with or without peroxyacid bleach precursors, builders and conventional detersive adjuncts.

Detersive Surfactants

The total amount of surfactants will be generally up to 70%, typically 1 to 55%, preferably 1 to 30%, more preferably 5 to 25% and especially 10 to 20% by weight of the total composition.

Nonlimiting examples of surfactants useful herein include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)x(CHOSO_3^-M^+)$ $CH_3$ and $CH_3$ $(CH_2)_y$ $(CHOSO_3^-M^+)$ $CH_2CH_3$ where x and (y+1) are integers of at least 7, preferably at least 9, and M is a water-solubilizing cation, especially sodium, unsaturated sulfates such as oleyl sulfate, the $C_{10}$–$C_{18}$ alkyl alkoxy sulfates ("AExS"; especially EO 1–7 ethoxy sulfates), $C_{10}$–$C_{18}$ alkyl alkoxy carboxylates (especially the EO 1–5 ethoxycarboxylates), the $C_{10\text{-}18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE"), including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used.

Other suitable surfactants suitable for the purpose of the invention are the anionic alkali metal sarcosinates of formula:

$$R—CON(R^1)CH_2COOM$$

wherein R is a $C_9$–$C_{17}$ linear or branched alkyl or alkenyl group, $R_1$ is a $C_1$–$C_4$ alkyl group and M is an alkali metal ion. Preferred examples are the lauroyl, cocoyl ($C_{12}$–$C_{14}$), myristyl and oleyl methyl sarcosinates in the form of their sodium salts.

Still another class of surfactant which may be suitable for the purpose of the invention are the cationic surfactant. Suitable cationic surfactants include the quatemary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Mixtures of anionic and nonionic surfactants are especially useful. Other conventional useful surfactants are listed in standard texts.

Proteases

When used, the compositions herein will typically comprise from 0.001% to 5% active protease by weight of the composition.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Mixture of the herein before described proteases may be used.

A most preferred protease is Savinase.

Source of Hydrogen Peroxide

An essential component of the detergent composition is a source of hydrogen peroxide. The source of hydrogen peroxide is normally incorporated at a level of at least 0.5% by weight, more preferably from 4% to 15% by weight and most preferably from 4% to 10% by weight of the composition.

Said source of hydrogen peroxide is a slow releasing source. The slow release of hydrogen peroxide source relative to that of the protease is such that the time to achieve a concentration that is 50% of the ultimate concentration of said enzyme is less than 120 seconds, preferably less than 90 seconds, more preferably less than 60 seconds, and the time to achieve a concentration that is 50% of the ultimate concentration of said hydrogen peroxide source is more than 180 seconds, preferably from 180 to 480 seconds, more preferably from 240 to 360 seconds. Preferably the time to achieve a concentration that is 50% of the ultimate concentration of said enzyme is at least 100 seconds less than the time to achieve a concentration that is 50% of the ultimate concentration for the hydrogen peroxide source.

Such slow release kinetic is more particularly described in pending GB Application No. 9407533.0.

In this respect, a preferred source of hydrogen peroxide is an inorganic perhydrate. A preferred perhydrate is perborate tetrahydrate of nominal formula $NaBO_2H_2O_2.3H_2O$. The inorganic perhydrate will normally be in the form of the sodium salt. More preferably, the source of hydrogen peroxide consists of at least 90% by weight of a perborate tetrahydrate.

Alternatively, other perhydrate compounds may be used in addition or in place of the perborate tetrahydrate together with appropriate means, such as coating, coagglomeration, to obtain a slow release of hydrogen peroxide. Such compounds can include perborate monohydrate, percarbonate, perphosphate, persilicate salts and mixtures thereof.

Of these compounds, a preferred perhydrate is percarbonate. Coarse percarbonate materials, of average particle size greater than 600 micrometers and preferably greater than 750 micrometers, may be used. Preferably, these percarbonate materials are coated with substances which are sparingly soluble in water. Water insoluble coating materials may be selected from fatty acid, polymers, hydrophobic silicas, waxes and magnesium silicates and mixtures thereof. Percarbonate materials which are exclusively coated with water-soluble substances such as citrates, borosilicates, borate derivatives, sodium carbonate or sodium/magnesium sulphate are not preferred.

When percarbonate is used, the source of hydrogen peroxide consists of at least 90% by weight of a percarbonate having a particle size of at least 600 micrometers and coated with water-insoluble materials.

Mixtures of any of the herein before described perhydrate compounds can also be used.

Preferably, the total amount of available oxygen present in the composition which include the available oxygen provided by the source of hydrogen peroxide with or without peroxyacid bleach precursors is less than 1.5% by weight. A method for determining $AvO_2$ levels is disclosed in European Patent Application No.93870004.4.

Organic Peroxyacid Bleach Precursor

Peroxyacid bleach precursors are compounds which react with hydrogen peroxide in a perhydrolysis reaction to produce a peroxyacid. Generally peroxyacid bleach precursors may be represented as

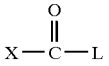

where L is a leaving group and X is essentially any functionality, such that on perhydrolysis the structure of the peroxyacid produced is

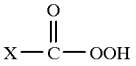

Peroxyacid bleach precursor compounds are preferably incorporated at a level of from 0.01% to 10% by weight, more preferably from 3% to 10% by weight, most preferably from 5% to 9% by weight of the precursor composition.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

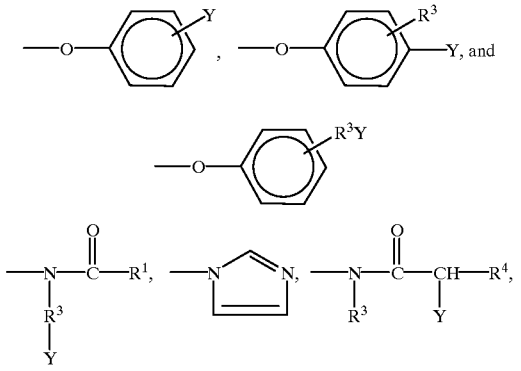

-continued

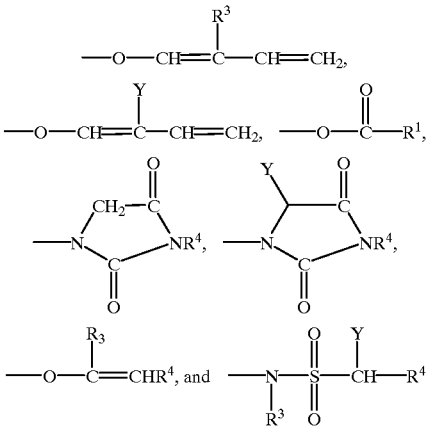

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammmonium groups.

The preferred solubilizing groups are $—SO_3^-M^+$, $—CO_2^-M^+$, $—SO_4^-M^+$, $—N^+(R^3)_4X—$ and $O<—N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Suitable peroxyacid bleach precursor materials are compounds which comprise at least one acyl group forming the peroxyacid moiety bonded to a leaving group through an —O— or —N— linkage.

These can be selected from a wide range of classes that include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

A preferred class of bleach precursor is the class of N-acylated precursors of which TAED is the preferred one.

Peroxyacid precursor compositions containing mixtures of any of the precursors hereinafter disclosed are also contemplated by the present invention.

Perbenzoic Acid Precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

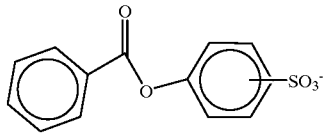

Also suitable are the benzoylation products of sorbitol, glucose, and all saccharides with benzoylating agents, including for example:

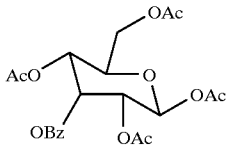

Ac = $COCH_3$; Bz = Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

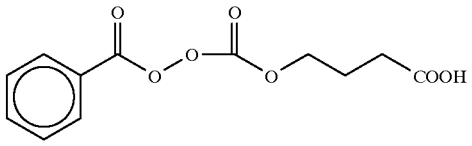

Phthalic anhydride is another suitable perbenzoic acid precursor compound herein:

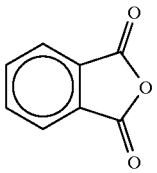

Suitable N-acylated precursor compounds of the lactam class are disclosed generally in GB-A-855735. Whilst the broadest aspect of the invention contemplates the use of any lactam useful as a peroxyacid precursor, preferred materials comprise the caprolactams and valerolactams.

Suitable caprolactam bleach precursors are of the formula:

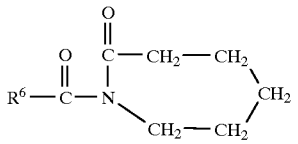

wherein $R^6$ is H or an alkyl, aryl, alkoxyaryl or alkaryl group containing from 1 to 12 carbon atoms, preferably from 6 to 12 carbon atoms.

Suitable valero lactams have the formula:

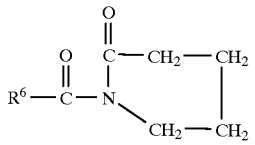

wherein $R^6$ is H or an alkyl, aryl, alkoxyaryl or alkaryl group containing from 1 to 12 carbon atoms, preferably from 6 to 12 carbon atoms. In highly preferred embodiments, $R^6$ is selected from phenyl, heptyl, octyl, nonyl, 2,4,4-trimethylpentyl, decenyl and mixtures thereof.

The most preferred materials are those which are normally solid at <30° C., particularly the phenyl derivatives, ie. benzoyl valerolactam, benzoyl caprolactam and their substituted benzoyl analogues such as chloro, amino alkyl, alkyl, aryl and alkyloxy derivatives.

Caprolactam and valerolactam precursor materials wherein the $R^6$ moiety contains at least 6, preferably from 6 to about 12, carbon atoms provide peroxyacids on perhydrolysis of a hydrophobic character which afford nucleophilic and body soil clean-up. Precursor compounds wherein $R^6$ comprises from 1 to 6 carbon atoms provide hydrophilic bleaching species which are particularly efficient for bleaching beverage stains. Mixtures of 'hydrophobic' and 'hydrophilic' caprolactams and valero lactams, typically at weight ratios of 1:5 to 5:1, preferably 1:1, can be used herein for mixed stain removal benefits.

Perbenzoic Acid Derivative Precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (ie; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

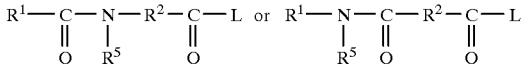

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic Peroxyacid precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammmonium group, preferably an ethyl or methyl ammonium group. Cationic peroxyacid precursors are typically present in the solid detergent compositions as a salt with a suitable anion, such as a halide ion.

The peroxyacid precursor compound to be so cationically substituted may be a perbenzoic acid, or substituted derivative thereof, precursor compound as described hereinbefore. Altematively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K 1,382,594; EP 475,512, 458,396 and 284,292; and in JP 87-318,332.

Examples of preferred cationic peroxyacid precursors are described in UK Patent Application No. 9407944.9 and U.S. patent application Ser. Nos. 08/298903, 08/298650, 08/298904 and 08/298906.

Suitable cationic peroxyacid precursors include any of the ammonium or alkyl ammonium substituted alkyl or benzoyl oxybenzene suffonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

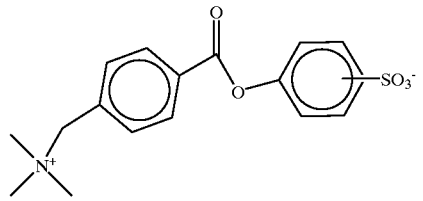

A preferred cationically substituted alkyl oxybenzene sulfonate has the formula:

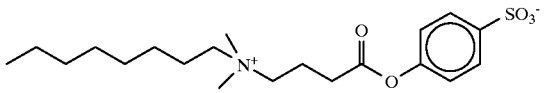

Preferred cationic peroxyacid precursors of the N-acylated caprolactam class include the trialkyl ammonium methylene benzoyl caprolactams, particularly trimethyl ammonium methylene benzoyl caprolactam:

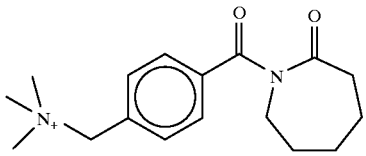

Other preferred cationic peroxyacid precursors of the N-acylated caprolactam class include the trialkyl ammonium methylene alkyl caprolactams:

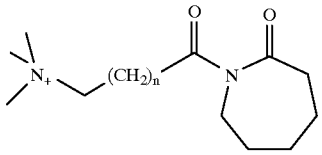

where n is from 0 to 12.

Another preferred cationic peroxyacid precursor is 2-(N,N,N-trimethyl ammonium) ethyl sodium 4-sulphophenyl carbonate chloride.

Benzoxazin organic peroxyacid precursors Also suitable are precursor compounds of the benzoxazin-type, as disclosed for example in EP-A-332,294 and EP-A-482,807, particularly those having the formula:

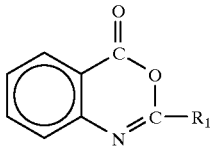

including the substituted benzoxazins of the type

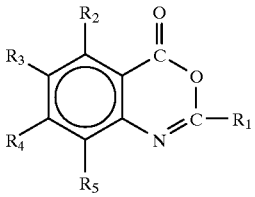

wherein $R^1$ is H, alkyl, alkaryl, aryl, arylalkyl, and wherein $R^2$, $R^3$, $R^4$, and $R^5$ may be the same or different substituents selected from H, halogen, alkyl, alkenyl, aryl, hydroxyl, alkoxyl, amino, alkyl amino, $COOR^6$ (wherein $R^6$ is H or an alkyl group) and carbonyl functions.

An especially preferred precursor of the benzoxazin-type is:

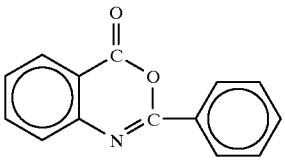

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N,N-N',N' tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-trimethyl hexanoyloxybenzene sulfonate (ISONOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are also suitable, including those of the following general formulae:

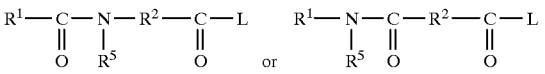

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Preferred amide substituted alkyl peroxyacid precursor compounds are (6-octanamido-caproyl) oxybenzenesulfonate, (6-nonanamidocaproyl)oxy benzene sulfonate and (6-decanamido-caproyl)oxybenzene sulfonate and mixture thereof.

More preferred peroxyacid bleach precursors compounds for use in the invention are selected from N,N-N',N' tetra acetyl ethylene diamine, 3,5,5-trimethyl hexanoyl oxybenzene sulfonate, nonanoyl oxybenzene sulfonate, amide substituted perbenzoic acid precursor compounds, amide substituted alkyl peroxyacid precursors and mixtures thereof.

A most preferred peroxyacid bleach precursor is N,N-N',N' tetra acetyl ethylene diamine.When used TAED will preferably be at a level of from 0.5% to 2.5% by weight.

Bleaching agents other than oxygen bleaching agents are also known in the art and can optionally be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from 0.025% to 1.25%, by weight, of such bleaches, especially sulfonate zinc phthalocyanine.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least 1% builder. Granular formulations typically comprise from 10% to 80%, more typically from 15% to 50% by weight, of the detergent builder. Lower or higher levels of builder, however, are not meant to be excluded.

These can include, but are not restricted to phytic acid, silicates, alkali metal carbonates (including bicarbonates and sesquicarbonates), sulphates, aluminosilicates, monomeric polycarboxylates, homo or copolymeric polycarboxylic acids or their salts in which the polycarboxylic acid comprises at least two carboxylic radicals separated from each other by not more than two carbon atoms. Examples of silicate builders are the crystalline layered silicates, such as the layered sodium silicates described in U.S. Pat. No. 4,664,839. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2Si_2O_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2Si_2O_5$ (NaSKS-6 form) is most preferred for use herein. Other silicates may also be useful such as for example magnesium silicate, which can serve as a crispening agent in granular formulations, as a stabilising agent for oxygen bleaches, and as a component of suds control systems.

Aluminosilicate builders are especially useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$Na_z[(AlO_2)_z(SiO_2)_y].xH2O$$

wherein z and y are integers of at least 6, the molar ratio of z to y is in the range from 1.0 to 0.5, and x is an integer from 15 to 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from 20 to 30, especially 27. This material is known as Zeolite A. Dehydrated zeolites (x=0–10) may also be used herein. Preferably, the aluminosilicate has a particle size of 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralised salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 and U.S. Pat. No. 3,635,830. See also "TMS/TDS" builders of U.S. Pat. No. 4,663,071. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, or acrylic acid, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the compositions containing the present invention are the 3,3-dicarboxy-4-oxa-1,6-hexanedioates and the related compounds disclosed in U.S. Pat. No. 4,566,984. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in EP 0,200,263.

Other suitable polycarboxylates are disclosed in U.S. Pat. No. 4,144,226 and in U.S. Pat. No. 3,308,067. See also U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Conventional Detersive Adjuncts

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Enzymes

Other enzymes than amylases and proteases may be used. These include cellulases, lipases, peroxidase, endoglucanase and mixtures thereof.

These enzymes may be incorporated into the composition in accordance with the invention at a level of from 0.001% to 5% active enzyme by weight of the composition.

The cellulases usable in the present invention include both bacterial or fungal cellulase. Preferably, they will have a pH optimum of between 5 and 9.5. Suitable cellulases are disclosed in U.S. Pat. No. 4,435,307, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. ENDO A, CAREZYME both from Novo Industries A/S are especially useful.

Suitable lipase enzymes for detergent usage include those produced by microorganisms of the Pseudomonas group, such as Pseudomonas stutzeri ATCC 19.154, as disclosed in GB 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (see also EP 341, 947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in EP-A-0,424,398.

A wide range of enzyme materials and means for their incorporation into synthetic detergent compositions are also disclosed in U.S. Pat. No. 3,553,139. Enzymes are further disclosed in U.S. Pat. No. 4,101,457 and in U.S. Pat. No. 4,507,219. Enzyme materials useful for liquid detergent formulations, and their incorporation into such formulations, are disclosed in U.S. Pat. No. 4,261,868. Enzymes for use in detergents can be stabilized by various techniques. Enzyme stabilisation techniques are disclosed and exemplified in U.S. Pat. No. 3,600,319 and EP 0 199 405. Enzyme stabilisation systems are also described, for example, in U.S. Pat. No. 3,519,570.

Enzyme Stabilizers

The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from 1 to 30, preferably from 2 to 20, more preferably from 5 to 15, and most preferably from 8 to 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from 0.05 to 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance.

The compositions herein may also optionally, but preferably, contain various additional stabilizers, especially borate-type stabilizers. Typically, such stabilizers will be used at levels in the compositions from 0.25% to 10%, preferably from 0.5% to 5%, more preferably from 0.75% to 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Polymeric Dispersing Agents

Polymeric dispersing agents can be utilized at levels from 0.1% to 7%, by weight, in the compositions herein.

A polymeric material which can be included is polyethylene glycol (PEG). PEG can exhibit dispersing agent performance as well as act as a clay soil removal-antiredeposition agent. Typical molecular weight ranges for these purposes range from 500 to 100,000, preferably from 1,000 to 50,000, more preferably from 1,500 to 10,000.

Polyaspartate and polyglutamate dispersing agents may also be used, especially in conjunction with zeolite builders. Dispersing agents such as polyaspartate preferably have a molecular weight (avg.) of 10,000.

Clay Soil Removal/Anti-redeposition Agents

The compositions of the present invention can also optionally contain water-soluble ethoxylated amines having clay soil removal and antiredeposition properties. Granular detergent compositions which contain these compounds typically contain from 0.01% to 10.0% by weight of the water-soluble ethoxylates amines; liquid detergent compositions typically contain 0.01% to 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least 25% oxyethylene units and more preferably, especially for such components having 20 to 30 oxypropylene units, at least 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$ –$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from 200, although higher levels can be used, preferably from 3 to 150, more preferably from 6 to 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers,copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from 25,000 to 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoarolyl, end-capped terephthalate esters.

If utilized, soil release agents will generally comprise from 0.01% to 10.0%, by weight, of the detergent compositions herein, typically from 0.1% to 5%, preferably from 0.2% to 3.0%.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises one sulfoisophthaloyl unit, 5 terephthaloyl units, oxyethyleneoxy and oxy-1,2-propyleneoxy units in a ratio of from 1.7 to 1.8, and two end-cap units of sodium 2-(2-hydroxyethoxy)-ethanesulfonate. Said soil release agent also comprises from 0.5% to 20%, by weight of the oligomer, of a crystalline-reducing stabilizer, preferably selected from the group consisting of xylene sulfonate, cumene sulfonate, toluene sulfonate, and mixtures thereof.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from 0.01% to 10% by weight of the composition, preferably from 0.01% to 5%, and more preferably from 0.05% to 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

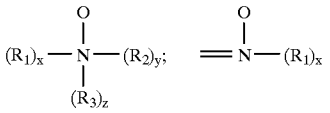

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO". The most preferred polyamine N-oxide useful in the detergent compositions herein is poly(4-vinylpyridine-N-oxide) which as an average molecular weight of 50,000 and an amine to amine N-oxide ratio of 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis, Vol* 113. "Modem Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinyl-pyrrolidone ("PVP") having an average molecular weight of from 5,000 to 400,000, preferably from 5,000 to 200,000, and more preferably from 5,000 to 50,000. PVP's are known to persons skilled in the detergent field; see, for example, EP-A-262,897 and EP-A-256,696. Compositions containing PVP can also contain polyethylene glycol ("PEG") having an average molecular weight from 500 to 100,000, preferably from 1,000 to 10,000. Preferably, the ratio of PEG to PVP on a ppm basis delivered in wash solutions is from 2:1 to 50:1, and more preferably from 3:1 to 10:1.

The detergent compositions herein may also optionally contain from 0.005% to 5% by weight of certain types of hydrophilic optical brighteners which also provide a dye transfer inhibition action. If used, the compositions herein will preferably comprise from 0.01% to 1% by weight of such optical brighteners.

The hydrophilic optical brighteners useful in the present invention are those having the structural formula:

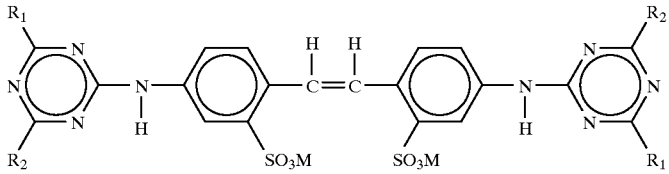

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4'-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-4-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Conventional optical brighteners or other brightening or whitening agents known in the art can be incorporated at levels typically from 0.005% to 5%, preferably from 0.01% to 1.2% and most preferably from 0.05% to 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Further optical brightener which may also be used in the present invention include naphthlimide, benzoxazole, benzofuran, benzimidazole and any mixtures thereof.

Specific examples of optical brighteners which are useful in the present compositions are those identified in U.S. Pat. No. 4,790,856. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD; the 2-(4-styryl-phenyl)-2H-naptho[1,2-d]triazoles; 4,4'-bis(1,2,3-triazol-2-yl)-stilbenes; 4,4'-bis(styryl)bisphenyls; and the aminocoumarins. Specific examples of these brighteners include 4-methyl-7-diethyl- amino coumarin; 1,2-bis(-benzimidazol-2-yl)ethylene; 1,3-diphenyl-pyrazolines; 2,5-bis(benzoxazol-2-yl)thiophene; 2-styryl-naptho-[1,2-d]oxazole; and 2-(stilbene4-yl)-2H-naphtho[1,2-d]triazole. See also U.S. Pat. No. 3,646,015.

Suds Suppressors

Compounds for reducing or suppressing the formation of suds can be incorporated into the compositions of the present invention. Suds suppression can be of particular importance in the so-called "high concentration cleaning process" and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of −40° C. and 50° C., and a minimum boiling point not less than 110° C. (atmospheric pressure). It is also known to utilize waxy hydrocarbons, preferably having a melting point below 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from 12 to 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from 20 cs. to 1,500 cs. at 25° C.;

(ii) from 5 to 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from 0.6:1 to 1.2:1; and (iii) from 1 to 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from 0.001 to 1, preferably from 0.01 to 0.7, most preferably from 0.05 to 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than 2 weight %; and without polypropylene glycol. Similar amounts can be used in granular compositions, gels, etc. See also U.S. Pat. No. 4,978,471, Starch, issued Dec. 18, 1990, and U.S. Pat. No. 4,983,316, Starch, issued Jan. 8, 1991, U.S. Pat. No. 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than 1,000, preferably between 100 and 800. The polyethylene glycol and polyethylene/polypropylene copolymers herein have a solubility in water at room temperature of more than 2 weight %, preferably more than 5 weight %.

The preferred solvent herein is polyethylene glycol having an average molecular weight of less than 1,000, more preferably between 100 and 800, most preferably between 200 and 400, and a copolymer of polyethylene glycol/polypropylene glycol, preferably PPG 200/PEG 300. Preferred is a weight ratio of between 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to 5% of suds suppressor. When utilized as suds suppressors, monocarboxylic fatty acids, and salts therein, will be present typically in amounts up to 5%, by weight, of the detergent composition. Preferably, from 0.5% to 3% of fatty monocarboxylate suds suppressor is utilized. Silicone suds suppressors are typically utilized in amounts up to 2.0%, by weight, of the detergent composition, although higher amounts may be used. This upper limit is practical in nature, due primarily to concern with keeping costs minimized and effectiveness of lower amounts for effectively controlling sudsing. Preferably from 0.01% to 1% of silicone suds suppressor is used, more preferably from 0.25% to 0.5%. As used herein, these weight percentage values include any silica that may be utilized in combination with polyorganosiloxane, as well as any adjunct materials that may be utilized. Monostearyl phosphate suds suppressors are generally utilized in amounts ranging from 0.1% to 2%, by weight, of the composition. Hydrocarbon suds suppressors are typically utilized in amounts ranging from 0.01% to 5.0%, although higher levels can be used. The alcohol suds suppressors are typically used at 0.2%–3% by weight of the finished compositions.

Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from 0.5% to 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

Other Ingredients

A wide variety of other functional ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional suds and to enhance grease removal performance.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to 6 carbon atoms and from 2 to 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between 6.5 and 11, preferably between 7.5 and 10.5. Liquid dishwashing product formulations preferably have a pH between 6.8 and 9.0. Laundry products are typically at pH 9–11. Techniques for controlling pH at recommended usage levels include the use of buffers, alkalis, acids, etc., and are well known to those skilled in the art.

Form of the Compositions

The detergent compositions of the invention can be formulated in any desirable form such as powders, granulates, pastes, liquids, and gels.

Liquid Compositions

The detergent compositions of the present invention may be formulated as liquid detergent compositions. Such liquid detergent compositions typically comprise from 94% to 35% by weight, preferably from 90% to 40% by weight, most preferably from 80% to 50% by weight of a liquid carrier, e.g., water, preferably a mixture of water and organic solvent.

Gel Compositions

The detergent compositions of the present invention may also be in the form of gels. Such compositions are typically formulated with polyakenyl polyether having a molecular weight of from about 750,000 to about 4,000,000.

Solid Compositions

The detergent compositions of the invention may also be in the form of solids, such as powders and granules.

The mean particle size of the components of granular compositions in accordance with the invention should preferably be such that no more that 5% of particles are greater than 1.4 mm in diameter and not more than 5% of particles are less than 0.15 mm in diameter.

The term mean particle size as defined herein is calculated by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass.

The bulk density of granular detergent compositions in accordance with the present invention are also useful in concentrated granular detergent compositions that are characterised by a relatively high density in comparison with conventional laundry detergent compositions. Such high density compositions typically have a bulk density of at least 600 g/liter, more preferably from 650 g/liter to 1200 g/liter, most preferably from 800 g/liter to 1000 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm high and has internal diameters of 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement eg; a knife, across its upper edge. The filled cup is then weighed and the value obtained for the weight of powder doubled to provide a bulk density in g/liter. Replicate measurements are made as required.

Making Processes-Granular Compositions

In general, granular detergent compositions in accordance with the present invention can be made via a variety of methods including dry mixing, spray drying, agglomeration and granulation.

The invention is illustrated in the following non limiting examples, in which all percentages are on a weight basis unless otherwise stated.

In the bleaching compositions of the invention, the abbreviated component identifications have the following meanings:

| | |
|---|---|
| LAS | Sodium linear $C_{12}$ alkyl benzene sulphonate |
| TAS | Sodium tallow alcohol sulphate |
| C45AS | Sodium $C_{14}$–$C_{15}$ linear alkyl sulphate |
| C45E7 | A $C_{14-15}$ predominantly linear primary alcohol condensed with an average of 7 moles of ethylene oxide |
| C25 E3 | A $C_{12-15}$ branched primary alcohol condensed with an average of 3 moles of ethylene oxide |
| Nonionic | (hydroxyethyl dimethyl) ammonium quaternary |
| Silicate | Amorphous Sodium Silicate ($SiO_2$:$Na_2O$; 1.6 ratio) |
| NaSKS-6 | Crystalline layered silicate of formula $\delta$-$Na_2Si_2O_5$ |
| Carbonate | Anhydrous sodium carbonate with a particle size between 200 $\mu$m and 900 $\mu$m |
| Sulphate | Anhydrous sodium sulphate |
| Zeolite A | Hydrated Sodium Aluminosilicate of formula $Na_{12}(A10_2SiO_2)_{12}.27H_2O$ having a primary particle size in the range from 0.1 to 10 micrometers |
| MA/AA | Copolymer of 1:4 maleic/acrylic acid, average molecular weight about 70,000. |
| PB4 | Sodium perborate tetrahydrate of nominal formula $NaBO_2.3H_2O.H_2O_2$ |
| TAED | Tetraacetyl ethylene diamine |
| $AvO_2$ | Total amount of available oxygen present in the composition |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulphonate. |
| HEDP | Hydroxy-ethylene 1,1 diphosphonate |
| DTPMP | Diethylene triamine penta (methylene phosphonate), marketed by Monsanto under the Trade name Dequest 2060 |
| EDDS | Ethylenediamine-N,N'-disuccinic acid, [S,S] isomer in the form of the sodium salt. |

-continued

| | |
|---|---|
| Silicone antifoam | Polydimethylsiloxane foam controller with Siloxane-oxyalkylene copolymer as dispersing agent with a ratio of said foam controller to said dispersing agent of 10:1 to 100:1. |
| Photoactivated bleach | Sulphonated Zinc Phthalocyanine encapsulated in dextrin soluble polymer |
| Savinase | proteolytic enzyme of activity 13 KNPU/g |
| Carezyme | cellulytic enzyme of activity 1000 CEVU/g |
| Termamyl | Amylolytic enzyme of activity 60 KNU/g |
| Lipolase | Lipolytic enzyme of activity 100 kLU/g |
| Endolase | Endoglunase A |
| | all sold by NOVO Industries A/S |
| PVNO | Polyvinylpyridine N-oxide |
| PVPVI | Copolymer of polyvinylpyrolidone and vinylimidazole |
| CMC | Sodium carboxymethyl cellulose |
| Metolose | Carboxy methoxy ether |
| SRA | Sulfobenzoyl end capped esters with oxyethylene |
| (Soil Release Agent) | oxy and terephthaloyl backbone |

EXAMPLE 1

The following formulations were prepared, where A and B are in accord with the invention and 1 and 5 are prior art compositions.

200 g from each formulations A,B and 1 to 5 was taken and subjected each to a full scale washing machine test using a Miele automatic washing machine (Model WM W698) set to the short wash cycle at 40° C. for each formulation. Water of 12° German hardness (=1.8 mol $Ca^{2+}$/liter) was used.

| Component (% by weight) | A | B | 1 | 2 | 3 | 4 | 5 |
|---|---|---|---|---|---|---|---|
| LAS | 5.4 | 5.4 | 5.4 | 5.4 | 5.4 | 5.4 | 5.4 |
| TAS | 1.9 | 1.9 | 1.9 | 1.9 | 1.9 | 1.9 | 1.9 |
| C25 E3 | 4.0 | 4.0 | 4.0 | 4.0 | 4.0 | 4.0 | 4.0 |
| nonionic | 0.60 | 0.60 | 0.60 | 0.60 | 0.60 | 0.60 | 0.60 |
| Zeolite A | 19.1 | 19.1 | 15.5 | 15.5 | 15.5 | 15.5 | 15.5 |
| MA/AA | 0.3 | 0.3 | 2.8 | 2.8 | 2.8 | 2.8 | 2.8 |
| PB4 | 9.25 | 9.25 | 14.1 | 14.1 | 14.1 | 14.1 | 14.1 |
| TAED | 1.8 | 1.4 | 1.6 | — | 1.8 | 1.0 | 2.5 |
| AvO2 | 1.02 | 0.93 | 1.43 | 1.53 | 1.87 | 1.59 | 2.11 |
| Carbonate | 20.5 | 20.5 | 18.6 | 18.6 | 18.6 | 18.6 | 18.6 |
| silicate | 2.8 | 2.8 | 4.7 | 4.7 | 4.7 | 4.7 | 4.7 |
| Savinase Protease | 0.28 | 0.33 | 0.12 | 0.15 | 0.19 | 0.13 | 0.28 |
| Termamyl Amylase | 0.10 | 0.10 | nil | nil | nil | nil | nil |
| DTPMP | 0.3 | 0.3 | 0.3 | 0.3 | 0.3 | 0.3 | 0.3 |
| HEDP | 0.2 | 0.2 | nil | nil | nil | nil | nil |

Minors and miscellaneous to balance

Two swatches demonstrating differing degrees of soil removal performance were used as standard to establish a 4 point scale in which '+' represents a very poor soil removal performance and '+++' average soil removal performance.

The two standards are used to define the mid points between the various descriptions of soil removal performance, viz + very poor soil removal performance ++ poor soil removal performance +++ average soil removal performance ++++ good soil removal performance Two expert panellists are used and their results are averaged.

The results are as follows:

| | A | B | 1 | 2 | 3 | 4 | 5 |
|---|---|---|---|---|---|---|---|
| Stain removal performance | ++++ | ++++ | + | + | + | + | ++ |

It is seen that Compositions A and B produce enhanced stain removal performance over the prior art Compositions 1 to 5.

EXAMPLE 2

The following base granule was prepared:

| Components | % by weight |
|---|---|
| LAS/TAS | 6.0/2.0 |
| C45 E7 | 4.0 |
| nonionic | 1.5 |
| Zeolite A | 20.0 |
| PB4 | 8.0 |
| TAED | 1.2 |
| Silicate (2.0 ratio) | 2.8 |
| Savinase protease (4 knpu/g) | 0.8 |
| DTPMP | 0.3 |

Minors and miscellaneous to balance

The following fractions were then incorporated in the base granule, where C is in accord with the invention and 6 and 7 are prior art compositions.

| Components | C | 6 | 7 |
|---|---|---|---|
| MA/AA | 0.9 | 2.8 | 4.5 |
| Termamyl amylase | 0.1 | 0.1 | 0.1 |
| Carbonate | 20.0 | 20.0 | 20.0 |
| HEDP | 0.22 | — | — |

200 g of each formulation were taken and placed into a Miele (W698) machine at 90° C. in 25° H water (5:1 Ca:Mg) together with white terry swatches and 2.5 kg of proteinaceous soiled laundry. For each formulations, 50 cycles were run. At the end of the test, the white swatches were graded and samples analysed for total ash and metal content.

It was seen that composition C produced better soil removal and less encrustation than compositions 6 and 7.

EXAMPLE 3

The following detergent compositions according to the invention were prepared:

| Components | D | E |
|---|---|---|
| LAS | 8.0 | 8.0 |
| C25 E3 | 4.10 | 4.10 |
| Zeolite A | 12.0 | 19.10 |
| Na SKS-6 | 6.16 | — |
| MA/AA | 1.50 | 0.30 |
| SRA | 0.10 | — |
| Metolose | 0.30 | — |
| PVNO/PVPVI | 0.02 | — |
| Carbonate | 20.50 | 20.5 |
| Silicate | — | 2.82 |
| PB4 | 12.0 | 9.25 |
| $AvO_2$ | 1.25 | 0.96 |
| TAED | 1.85 | 1.85 |
| EDDS | 0.19 | — |

-continued

| Components | D | E |
|---|---|---|
| DTPMP | — | 0.25 |
| HEDP | 0.20 | 0.22 |
| $MgSO_4$ | 0.30 | 0.30 |
| Savinase protease | 0.50 | 0.28 |
| Lipolase lipase | 0.12 | — |
| Termamyl amylase | 0.38 | 0.10 |
| Carezyme Cellulase | 0.08 | — |
| Endolase | 0.08 | — |
| CMC | — | 0.22 |
| Brightener 1 | 0.12 | — |
| Brightener 2 | — | 0.11 |
| Photoactivated bleach | 0.003 | 15 ppm |
| Silicone antifoam | 0.10 | 0.55 |
| Sulphate | 24.0 | 25.88 |
| Perfume | 0.25 | 0.27 |

Minors and miscellaneous to balance

The above formulations was seen to produce enhanced soil removal performance and reduced encrustation.

What is claimed is:

1. A non-phosphate builder-containing detergent composition comprising a surfactant, a water-soluble organic polymeric polycarboxylic compound, a chelant, an amylase and a source of alkalinity, wherein a)—said water-soluble organic polymeric polycarboxylic compound is in an amount less than 3% by weight, b)—said chelant is in an amount from 0.1% to 10% by weight, c)—said amylase is in an amount from 0.001% to 5% by weight, and d)—said alkalinity source has the capacity to deliver alkalinity to a wash solution as measured by the alkalinity release test described herein, such that the % weight NaOH equivalent of the composition is greater than 8.0% by weight of the composition, provided that said water-soluble organic polymeric polycarboxylic compound and said alkalinity source are present in a weight ratio of 0.0732:1 or less.

2. A detergent composition according to claim 1, wherein said chelant is selected from organic phosphonates, amino carboxylates, polyfunctionally-substituted aromatic chelating agents, nitriloacetic acid and mixtures thereof.

3. A detergent composition according to claim 2, wherein said chelant is an organic phosphonate chelant selected from α-hydroxy-2 phenyl ethyl diphosphonate, methylene diphosphonate, hydroxy 1,1-hexylidene, vinylidene 1,1 diphosphonate, 1,2 dihydroxyethane 1,1 diphosphonate and hydroxy-ethylene 1,1 diphosphonate.

4. A detergent composition according to claim 2, wherein said chelant is hydroxy-ethylene 1,1 diphosphonate.

5. A detergent composition according to claim 3, wherein said polycarboxylic compound is a co-polymeric polycarboxylic acid having monomeric unit selected from acrylic acid, maleic acid, fumaric acid, itaconic acid, aconitic acid, mesaconic acid, citraconic acid and methylenemalonic acid and mixtures thereof.

6. A detergent composition according to claim 5, wherein said polycarboxylic compound is in amount less than 1% by weight.

7. A detergent composition according to claim 5, wherein said amylase is selected from the group consisting of α-amylases.

8. A detergent composition according to claim 7 wherein said composition further comprises a protease in amount from 0.001% to 5% by weight.

9. A non-phosphate builder-containing detergent composition comprising a surfactant, a source of hydrogen peroxide, a water-soluble organic polymeric polycarboxylic compound, a chelant, an amylase and a source of alkalinity, wherein a)—said water-soluble organic polymeric polycarboxylic compound is in an amount less than 3% by weight, b)—said chelant is in an amount from 0.1% to 10% by weight, c)—said amylase is in an amount from 0.001% to 5% by weight, and d)—said alkalinity source has the capacity to deliver alkalinity to a wash solution as measured by the alkalinity release test described herein, such that the % weight NaOH equivalent of the composition is greater than 8.0% by weight of the composition, provided that said water-soluble organic polymeric polycarboxylic compound and said alkalinity source are present in a weight ratio of 0.0732:1 or less.

10. A detergent composition according to claim 9, wherein said chelant is an organic phosphonate chelant selected from the group consisting of α-hydroxy-2 phenyl ethyl diphosphonate, methylene diphosphonate, hydroxy 1,1-hexylidene, vinylidene 1,1 diphosphonate, 1,2 dihydroxyethane 1,1 diphosphonate and hydroxy-ethylene 1,1 diphosphonate.

11. A detergent composition according to claim 9, wherein said polycarboxylic compound is a co-polymeric polycarboxylic acid having monomeric unit selected from the group consisting of acrylic acid, maleic acid fumaric acid, itaconic acid, aconitic acid, mesaconic acid, citraconic acid and methylenemalonic acid and mixtures thereof.

12. A detergent composition according to claim 11, wherein said polycarboxylic compound is in amount less than 1% by weight.

13. A detergent composition according to claim 11, wherein said detergent composition further comprises a protease in amount from 0.001% to 5% by weight.

14. A detergent composition according to claim 13, wherein the source of hydrogen peroxide is an inorganic perhydrate selected from the group consisting of perborate tetrahydrate, perborate monohydrate, percarbonate and mixtures thereof.

15. A detergent composition according to claim 14 wherein said detergent composition comprises a bleach precursor compound selected from the group consisting of bleach precursor compounds which comprise at least one acyl group forming the peroxyacid moiety bonded to a leaving group through an —O— or —N— linkage.

16. A detergent composition according to claim 15, wherein said bleach precursor is N,N-N',N' tetra acetyl ethylene diamine.

17. A detergent composition according to claim 16, wherein said bleach precursor compound is in amount from 0.5% to 2.5% by weight.

18. A method for reducing fabric encrustation which comprises contacting the fabric with an effective amount of an aqueous solution of a non-phosphate builder-containing detergent composition formulated with a surfactant, a water-soluble organic polymeric polycarboxylic compound, a chelant, an amylase and a source of alkalinity, wherein a)—said water-soluble organic polymeric polycarboxylic compound is in an amount less than 3% by weight, b)—said chelant is in an amount from 0.1% to 10% by weight, c)—said amylase is in an amount from 0.001% to 5% by weight, and d)—said alkalinity source has the capacity to deliver alkalinity to a wash solution as measured by the alkalinity release test described herein, such that the % weight NaOH equivalent of the composition is greater than 8.0% by weight of the composition, provided that said water-soluble organic polymeric polycarboxylic compound and said alkalinity source are present in a weight ratio of 0.0732:1 or less.

19. A method according to claim 18, wherein said detergent composition comprises a chelant selected from the group consisting of organic phosphonates, amino carboxylates, polyfunctionally-substituted aromatic chelating agents, nitriloacetic acid and mixtures thereof.

20. A method according to claim 19, wherein said chelant is an organic phosphonate chelant selected from the group consisting of α-hydroxy-2 phenyl ethyl diphosphonate, methylene diphosphonate, hydroxy 1,1-hexylidene, vinylidene 1,1 diphosphonate, 1,2 dihydroxyethane 1,1 diphosphonate and hydroxy-ethylene 1,1 diphosphonate.

21. A method according to claim 18, wherein said chelant is hydroxy-ethylene 1,1 diphosphonate.

22. A method according to claim 20, wherein said polycarboxylic compound is a co-polymeric polycarboxylic acid having monomeric unit selected from the group consisting of acrylic acid, maleic acid, fumaric acid, itaconic acid, aconitic acid, mesaconic acid, citraconic acid and methylenemalonic acid and mixtures thereof.

23. A method according to claim 22, wherein said polycarboxylic compound is in amount less than 1% by weight.

24. A method according to claim 22, wherein said amylase is selected from the group consisting of α-amylases.

* * * * *